United States Patent [19]

Smith

[11] 4,335,509

[45] Jun. 22, 1982

[54] BEARD AND MOUSTACHE TRIMMER

[76] Inventor: Sarah L. Smith, 20710 Rosedale St., St. Clair Shores, Mich. 48080

[21] Appl. No.: 148,329

[22] Filed: May 9, 1980

[51] Int. Cl.[3] ..... B26B 21/06

[52] U.S. Cl. ..... 30/48; 30/340

[58] Field of Search ..... 30/47, 48, 32, 62, 85, 30/335, 339, 340; D28/45–48

[56] References Cited

U.S. PATENT DOCUMENTS

| | | | |
|---|---|---|---|
| D. 193,299 | 7/1962 | Dreyfuss . | |
| D. 217,752 | 6/1970 | Barry . | |
| 1,048,154 | 12/1912 | Harley | 30/48 X |
| 1,558,021 | 10/1925 | Libi . | |
| 1,681,207 | 8/1928 | Anshelm . | |
| 1,979,404 | 11/1934 | Pautler . | |
| 2,324,555 | 7/1943 | Blunk . | |
| 2,679,094 | 5/1954 | Nolan . | |
| 2,787,831 | 4/1957 | Siegel . | |
| 2,960,769 | 11/1960 | Matwijcow | 30/339 X |
| 3,136,056 | 6/1964 | Reynier | 30/32 X |
| 3,140,541 | 7/1964 | Craig | 30/62 |
| 3,187,431 | 6/1965 | Mattes | 30/339 |
| 3,363,312 | 1/1968 | Fayed | 30/85 X |
| 4,128,937 | 12/1978 | Adorney . | |

*Primary Examiner*—Nicholas P. Godici

*Attorney, Agent, or Firm*—Alex Rhodes

[57] ABSTRACT

This invention relates to manual cutting implements for grooming and styling hair. A cutting implement having a unitary blade and shank attached to an elongated handle is provided which is particularly adapted to the trimming and shaping of beards, moustaches, sideburns and the like. The shank extends angularly away from the axis of the handle to a union with the blade wherefrom the blade appends angularly towards the handle and terminates at an oblique cutting edge, extending across the width of the blade. The ends of the blade project beyond the sides of the shank thereby exposing the ends of the cutting edge to the view of the user. Apparatus are provided for steadying the user's hand and controlling the pressure of the cutting edge against the surface in contact with the blade.

4 Claims, 7 Drawing Figures

FIG.7
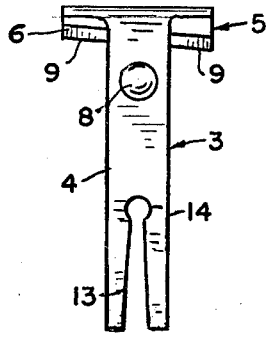
FIG.5
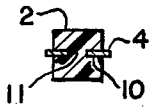
FIG.6
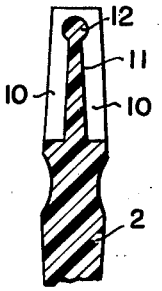
FIG.4
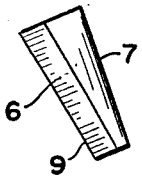
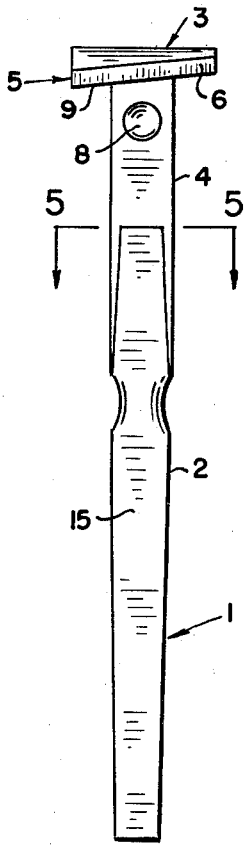
FIG. 1
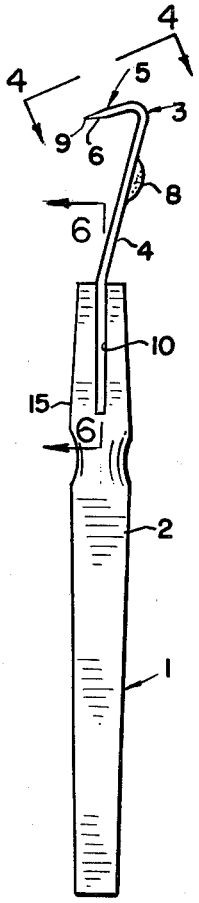
FIG.2
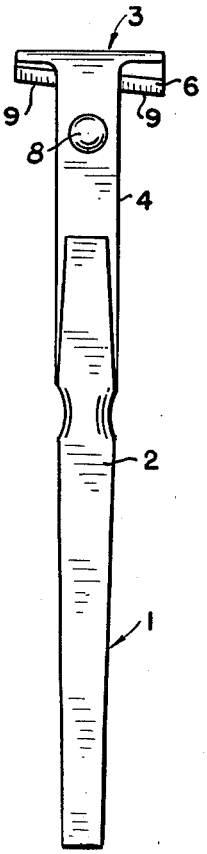
FIG.3

BEARD AND MOUSTACHE TRIMMER

BACKGROUND OF THE INVENTION

During recent years, it has again become fashionable and the mark of full manhood for the wearing of beards, moustaches and long sideburns. This has created a need for improved implements for grooming and styling hair.

Heretofore, devices commonly used for removing facial hair have consisted of the "old fashioned" straight razor, the safety razor and the electric dry shaver. The safety razor, the most popular shaving implement, is especially adapted for the "clean shaven" look wherein facial hair is entirely removed. The principle of the safety rzor is to place a guard between the skin and the cutting edge of a razor blade, so that the guard permits the cutting edge to pass over the surface to be shaved, removing the hair without cutting the skin. The safety razor is not satisfactory for grooming and shaping beards, moustaches and sideburns because the blade holder and guard obscure the cutting edge from the user's view and the configurations of the holder, guard and blade are not adapted for the shaping and trimming of the margins of beards, moustaches and sideburns.

The straight razor with its three to four inch long blade and pivoting handle is difficult to use without cutting the skin. Once in popular use, the straight razor requires training and skill currently found in persons skilled in the art of barbering.

The electric dry shaver, although efficient for shaving large areas is not adapted for shaping and trimming the margins of beards, moustaches, sideburns and the like.

With the foregoing in view, the primary object of the instant invention is to provide an improved yet simple and effective cutting implement for grooming and shaping beards, moustaches, sideburns and the like which can be used by persons unskilled in the art of barbering.

It is a further object to provide an implement which is of reasonable cost and simple to manufacture.

It is a further object to provide in a hair trimming implement a means for steadying the hand of the user and controlling the pressure of the cutting edge against the surface in contact with the blade.

The foregoing objects, along with additional objects, features, advantages, and benefits of the invention, become more apparent in the ensuing description and accompanying drawings which disclose the invention in detail. A preferred embodiment is disclosed in accordance with the best mode presently contemplated in carrying out the invention. The subject matter in which an exclusive property is claimed is set forth in each of the numbered claims at the conclusion of the description.

SUMMARY OF THE INVENTION

The present invention is directed toward a hair trimming implement for grooming and styling hair, and in particular to trimming and shaping the edges of beards, moustaches, sideburns and the like. The hair trimming implement includes an elongated handle with an attached unitary blade and shank. One end of the shank is aligned with the axis of the handle to which it is attached. The other portion of the shank extends angularly away from the axis of the handle to a union with the blade wherefrom the blade appends angularly towards the handle and terminates at an oblique cutting edge which extends across the width of the blade. The end portions of the cutting edge extend beyond the sides of the shank thereby exposing the ends to the view of the user. The width of the blade is somewhat less than the width of a typical blade for a safety razor and improves access to confined areas. A finger rest is provided on the angular portion of the shank upon which the user's finger is brought to bear for steadying the user's hand and controlling the pressure of the cutting edge against the surface in contact with the blade. Means are provided for attaching the unitary blade and shank to the handle.

BRIEF DESCRIPTION OF THE DRAWINGS

FIG. 1 is a front elevational view of a beard and moustache trimmer constructed in accordance with the present invention.

FIG. 2 is a left side elevational view.

FIG. 3 is a rear elevational view.

FIG. 4 is a view of the blade taken in the direction of arrows 4—4 of FIG. 2.

FIG. 5 is a cross sectional view taken on the line 5—5 of FIG. 1.

FIG. 6 is a cross sectional view taken on the line 6—6 of FIG. 2 wherein only the upper portion of the handle is illustrated.

FIG. 7 is a rear elevational view of only the unitary blade and shank.

DESCRIPTION OF THE PREFERRED EMBODIMENT

Referring now to the drawings wherein like reference numerals refer to like and corresponding parts throughout the several views, a preferred embodiment 1 of the present invention is illustrated as having an elongated handle 2 with an attached unitary blade and shank 3. The unitary blade and shank 3 is shown as being constructed from a strip of material of uniform thickness. The material of the blade and shank 3 may be any appropriate type of alloy steel, capable of maintaining a fine cutting edge. Fabrication of the blade and shank 3 from a strip of steel is particularly advantageous for reducing cost by the stamping process. Preferably, the material for the blade and shank 3 should have some resistance to corrosion.

The elongated handle 2 is made by injection molding from a low cost plastic material, such as, acrylonitrile butadiene styrene or another material with similar properties. One end of the shank portion 4 of the unitary blade and shank 3 is attached to an end portion of the handle 2 and aligned with the axis of said handle 2. The remaining portion of the shank 4 extends angularly away from the axis of the handle 2 to a union 7 with the blade portion 5 of the unitary blade and shank 3, wherefrom the blade portion 5 appends angularly downward towards the handle 2.

At the outer edge of the blade 5, opposite the shank 4, is an oblique cutting edge 6. The cutting edge 6 is formed by grinding a wedge shaped section, with sides tapering to a sharp edge, as shown in FIG. 2, or by hollow grinding to improve the fineness of the cutting edge 6. A commonly used method for producing the required type of cutting edge 6 consists of the steps of hardening and tempering followed by grinding, glazing and buffing of the cutting edge 6 on small leather wheels charged with a polishing material.

The width of the blade 5 is somewhat less than the typical widths of blades for safety and straight razors, being within the range of one-half to one and one-quarter inches as compared to widths of one and one-half inches for the safety razor and three to four inches for the straight razor. The narrower width improves access to confined areas, particularly those areas adjacent to the mouth, nose and ears.

The shape of the blade 5, shank 4 and cutting edge 6 provides several noteworthy benefits. The downward appending blade 5 and oblique cutting edge 6 produce a cleaner, more efficient cutting of the hair, rather than shearing thereof. The shape of the shank 4 which extends angularly away from the axis of the handle 2 positions the cutting edge 6 within the inner surface 15 of the handle 2 thereby protecting the cutting edge 6 against damage when the implement 1 is rested on the inner handle surface 15. Of yet further benefit to the user is the exposure to view of the ends 9 of the cutting edge, which project beyond the sides of the shank 4.

On the back surface of the shank 4 is a spherical embossment which serves as a finger rest 8 for the forefinger of a user. The finger rest 8 provides several advantages for a user who is unskilled in the art of barbering. Positioning the forefinger on the rest 8, during each use of the implement 1, duplicates the manner of holding the implement 1, thus ensuring the same kind of results. Furthermore, the pressure of the user's forefinger against the rest 8 steadies the user's hand thereby improving the control of the pressure of the cutting edge 6 against the surface in contact with the blade 5.

At the upper end portion of the handle 2 is a pair of notches 10 for receiving the lower end portion of the shank 4. The interior sides of the notches 10 form a rib 11 having tapered sides and an arcuate projection 12 at the upper portion thereof. At the lower portion of the shank 4, as viewed in FIG. 7, is a corresponding slot 13 and arcuate opening 14 at the upper portion thereof. The sides of the slot 13 are tapered to engage the tapered sides of the rib 11. The unitary blade and shank 3 is assembled to the handle 2 by engaging the lower portion of the shank 4 with the notches 10 of the handle 2 and forcing the opening 14 into engagement with the projection 12, the shank portions adjacent to the slot 13 being sufficiently resilient to allow an engagement of the opening 14 with the projection 12. To replace the unitary blade and shank 3, a force is exerted which is sufficient to disengage the blade and shank 3 from the handle 2. Optionally, a non-removable blade and shank may be provided by bridging the lower end of the slot 13 and injection molding the handle 2 onto the unitary blade and shank 3.

In retrospect, what has been accomplished with the present invention is a beard and moustache trimmer for grooming and shaping beards, moustaches, sideburns and the like having features, advantages and benefits heretofore not available in the art. The beard and moustache trimmer is reasonable in cost, simple to manufacture and can be used by ordinary persons not skilled in the art of barbering.

Although a specific embodiment has been disclosed and described herein, it is obvious that changes can be made in the detail of the elements thereof without departing from the spirit and scope thereof as defined by the appended claims. For example, alternate embodiments may be constructed wherein the cutting edge is parallel to the shank or is oblique with an opposite slope as illustrated herein.

I claim:

1. A hair trimmer with an unguarded cutting edge, particularly adapted for grooming and shaping beards, moustaches, sideburns and the like, comprising:

an elongated handle;

a unitary blade and shank constructed from a strip of metal of uniform thickness, one end portion of the shank aligned with the axis of the handle and attached to the upper end portion of the handle, the remaining portion of the shank extending obliquely from the other shank portion to a union with the blade wherefrom the blade of a width greater than the width of said shank appends angularly downward towards the handle and terminates at an oblique unguarded cutting edge, said cutting edge being within the inner surface of the handle whereby said cutting edge is protected against damage when said hair trimmer is rested on said inner surface;

a finger rest on said shank whereby the forefinger of a user is brought to bear for steadying the user's hand and controlling the pressure of the cutting edge of the blade against the surface in contact with the cutting edge;

a pair of opposing notches in corresponding sides of the upper end portion of the handle for receiving the lower end portion of the shank;

a rib in the upper end portion of the handle, said rib being formed by the interior sides of the notches and having tapered sides and an arcuate shaped projection at the upper portion thereof; and a slot in the lower portion of the shank, said slot having a shape corresponding to the shape of said rib whereby the shank is assembled to the handle by engaging the lower portion of the shank with the notches of the handle and forcing the rib and arcuate projection thereof into engagement with the slot and arcuate opening thereof, said shank being sufficiently resilient to engage the arcuate projection of the rib with the corresponding arcuate opening of the shank.

2. A hair trimmer with an unguarded cutting edge, particularly adapted for grooming and shaping beards, moustaches, sideburns and the like, comprising:

an elongated handle;

a replaceable unitary blade and shank, the shank thereof being about the same width as the handle, one end portion of the shank aligned with the axis of the handle and attached to an end portion of the handle, the remaining portion of the shank extending obliquely from the other shank portion to a union with the blade, said blade appending angularly downward from the union with the shank towards the handle to an unguarded cutting edge at the other end portion of the blade, the cutting edge extending across the full width of the blade, said width being substantially greater than the width of the shank whereby the ends of the cutting edge extend beyond the sides of the shank and are exposed for the view and use of a user;

a means for steadying the hand of the user and controlling the pressure of the cutting edge against the surface in contact with the cutting edge; and a means for attaching the replaceable unitary blade and shank to the handle, said means having a pair of opposing notches in corresponding side portions of the handle for receiving the lower end portion of the replaceable unitary blade and shank, the width of the notches being about the same as the thickness of the unitary blade and shank, a rib in the upper end portion of the handle, said rib being formed by the interior sides of the notches and having tapered sides and an arcuate shaped projection at the upper portion thereof, and a slot in the lower end portion of the unitary blade and shank for engaging the upper end portion of the handle, said slot having a shape corresponding to the shape of said rib whereby the blade and shank are assembled to the handle by engaging the lower portion of the shank with the notches in the handle sides and forcing the rib and arcuate projection thereof into engagement with the slot and arcuate opening thereof, said shank being sufficiently resilient to engage the arcuate projection of the rib with the corresponding arcuate opening of the slot.

3. A hair trimmer with an unguarded cutting edge, particularly adapted for grooming and shaping beards, moustaches, sideburns and the like, comprising:

an elongated handle;

a unitary blade and shank, the shank thereof being about the same width as the handle, one end portion of the shank aligned with the axis of the handle and attached to an end portion of the handle, the remaining portion of the shank extending obliquely from the other shank portion to a union with the blade, said blade appending angularly downward from the union with the shank towards the handle to an unguarded cutting edge at the other end portion of the blade having an oblique relationship to the union of the blade and shank and extending across the full width of the blade, said width being substantially greater than the width of the shank whereby the ends of the cutting edge extend beyond the sides of the shank and are exposed for the view and use of a user;

a means for steadying the hand of the user and controlling the pressure of the cutting edge against the surface in contact with the cutting edge; and a means for attaching the shank to the handle.

4. A hair trimmer with an unguarded cutting edge, particularly adapted for grooming and shaping beards, moustaches, sideburns and the like, comprising:

an elongated handle;

a replaceable unitary blade and shank, the shank thereof being about the same width as the handle, one end portion of the shank aligned with the axis of the handle and attached to an end portion of the handle, the remaining portion of the shank extending obliquely from the other shank portion to a union with the blade, said blade appending angularly downward from the union with the shank towards the handle to an unguarded cutting edge at the other end portion of the blade having an oblique relationship to the union of the blade and shank and extending across the full width of the blade, said width being substantially greater than the width of the shank whereby the ends of the cutting edge extend beyond the sides of the shank and are exposed for the view and use of a user;

a means for steadying the hand of the user and controlling the pressure of the cutting edge against the surface in contact with the cutting edge; and a means for attaching the replaceable unitary blade and shank to the handle, said means having a pair of opposing notches in corresponding side portions of the handle for receiving the lower end portion of the replaceable unitary blade and shank, the width of the notches being about the same as the thickness of the unitary blade and shank, a rib in the upper end portion of the handle, said rib being formed by the interior sides of the notches and having tapered sides and an arcuate shaped projection at the upper portion thereof, and a slot in the lower end portion of the unitary blade and shank for engaging the upper end portion of the handle, said slot having a shape corresponding to the shape of said rib whereby the blade and shank are assembled to the handle by engaging the lower portion of the shank with the notches in the handle sides and forcing the rib and arcuate projection thereof into engagement with the slot and arcuate opening thereof, said shank being sufficiently resilient to engage the arcuate projection of the rib with the corresponding arcuate opening of the slot.

* * * * *